US006602088B1

(12) United States Patent
Zhu

(10) Patent No.: US 6,602,088 B1
(45) Date of Patent: Aug. 5, 2003

(54) MINI UNIVERSAL SERIAL BUS CABLE CONNECTOR HAVING MEANS FOR IMPROVING ITS ATTACHMENT TO AN HAND HELD ELECTRONIC DEVICE

(75) Inventor: Jian-Guo Zhu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/196,987

(22) Filed: Jul. 16, 2002

(30) Foreign Application Priority Data

Apr. 12, 2002 (CN) ..... 91204868 U

(51) Int. Cl.[7] ..... H01R 13/648

(52) U.S. Cl. ..... 439/382; 439/385; 439/732; 439/278; 439/281; 439/283; 439/588

(58) Field of Search ..... 439/610, 382, 439/383, 384, 385, 732, 278, 281, 283, 588, 607

(56) References Cited

U.S. PATENT DOCUMENTS 969,409 A * 9/1910 Russell ..... 439/535
2,668,187 A * 2/1954 Wald, Jr. et al. ..... 174/153 A
2,759,160 A * 8/1956 Kelley ..... 439/371
3,048,673 A * 8/1962 Kirk ..... 200/51 R
3,332,051 A * 7/1967 Pippin, Jr. et al. ..... 439/385
3,665,509 A * 5/1972 Elkins ..... 439/42
3,786,400 A * 1/1974 Ege ..... 439/372
4,299,431 A * 11/1981 Wilson et al. ..... 439/281
4,894,023 A * 1/1990 Hall ..... 439/278
5,762,510 A * 6/1998 Taniguchi et al. ..... 439/271
6,089,910 A * 7/2000 Suzuki et al. ..... 439/559
D434,727 S 12/2000 Huang
6,210,231 B1 4/2001 Lai
6,280,252 B1 8/2001 Huang
6,305,989 B1 * 10/2001 Quadir ..... 439/685

* cited by examiner

*Primary Examiner*—Tho D. Ta
(74) *Attorney, Agent, or Firm*—Wei Te Chung

(57) ABSTRACT

A cable connector (1) includes an insulative housing (10), a plurality of terminals (20) received in the housing, a pair of shells (30, 40) covering the housing, and an insulative casing portion (50) enclosing the shells. The insulative housing includes a main body (11) and a projection portion (12) forwardly projecting from the main body and received into a mating frame (33) of the shell 30. An abutment wall (55) is integrally formed on a front end of the casing portion and extends generally perpendicularly to a lengthwise direction of the connector. Two adjacent flanges (550, 552) of the abutment wall are bent forwardly for tightly engaging with an outer surface of a hand held electronic device. A hole (59) is defined through the abutment wall for extension of the projection portion of the housing and a front portion of the conductive shell.

7 Claims, 8 Drawing Sheets

MINI UNIVERSAL SERIAL BUS CABLE CONNECTOR HAVING MEANS FOR IMPROVING ITS ATTACHMENT TO AN HAND HELD ELECTRONIC DEVICE

BACKGROUND OF THE INVENTION

1. Field of the Invention

The present invention relates to a cable connector, and particularly to a mini universal serial bus (USB) cable connector for engaging with a hand held electronic device to connect the device with a computer main frame.

2. Description of Related Art

A Universal Serial Bus (USB) connector is widely used for connecting a computer and a peripheral device. The USB connector can transmit signals at a high speed and has become a standard auxiliary device for computer systems. For understanding the USB connector, one can refer to Universal Serial Bus Specification Revision 1.1 issued by Compaq, Intel, Microsoft, and NEC. Furthermore, U.S. Pat. Nos. 6,280,252, 6,210,231, 6,293,825, 6,231,393, D433, 665, D434,727, D432,085 disclose some USB connectors.

A mini USB connector is much smaller than a standard USB connector and is widely used for connecting a hand-held device, such as a digital camera or a personal digital assistant (PDA) to a computer. U.S. Pat. No. 6,280,252 discloses a mini USB cable connector. The structure of the prior art mini USB cable connector is disclosed in FIG. 7 and FIG. 8 of the present application. The connector 1' comprises an insulative housing 2', a plurality of terminals 3', an upper shell 4', a lower shell 5', and a casing portion 6'. The insulative housing 2' has a projection portion and a plurality of passageways 20' defined in the projection portion. The terminals 3' are received in the passageways 20'. The upper shell 4' comprises an upper section 40' and a front section 42' extending forwardly from a front edge of the upper section 40'. The front section 42 receives the projection portion of the insulative housing 2' therein. The lower shell 5' engages with the upper shell 4' for providing EMI shielding to the terminals 3'. The casing portion 6' is inserted molded around the upper shell 4' and the lower shell 5'. When the connector 1' mates with a complementary connector (not shown), the front portion 42' and the projection portion are inserted into the complementary connector. Because the front portion of the connector 1' is very small, a retaining force between the connector 1' and the complementary connector is not enough. The connector 1' is easy to separate from the complementary connector, thereby influencing signal transmission therebetween. Furthermore, the casing portion is much bigger than the front portion of the connector, a small vibration of the casing portion may cause the front portion of the connector 1' to separate from the complementary connector, whereby an electrical connection achieved by the connectors is broken.

Hence, an improved mini USB cable connector which can securely engage with the complementary connector in a hand held electronic device is required to overcome the disadvantages of the prior art.

SUMMARY OF THE INVENTION

Accordingly, an object of the present invention is to provide a mini USB cable connector having means for achieving a firm and tight attachment of the connector to a hand held electronic device.

A mini USB cable connector for mating with a complementary connector of a hand held electronic device comprises an insulative housing comprising a main body, a projection portion extending forwardly from the main body and a plurality of passageways defined in the projection portion, a plurality of terminals received in the passageways of the projection portion, a conductive shell enclosing the insulative housing and an insulative casing portion. The casing portion encloses a rear portion of the conductive shell and comprises an abutment wall integrally formed on a front end thereof. The abutment wall extends generally perpendicularly to a lengthwise direction of the connector. A hole is defined through the abutment wall for extension of the projection portion of the insulative housing and a front portion of the conductive shell. The abutment wall has a flange bent forwardly for tightly engaging with an outer surface of the hand held electronic device when the mini USB cable connector mates with the complementary connector mounted in the electronic device.

Other objects, advantages and novel features of the invention will become more apparent from the following detailed description when taken in conjunction with the accompanying drawings.

DETAILED DESCRIPTION OF THE INVENTION

Figure 1:
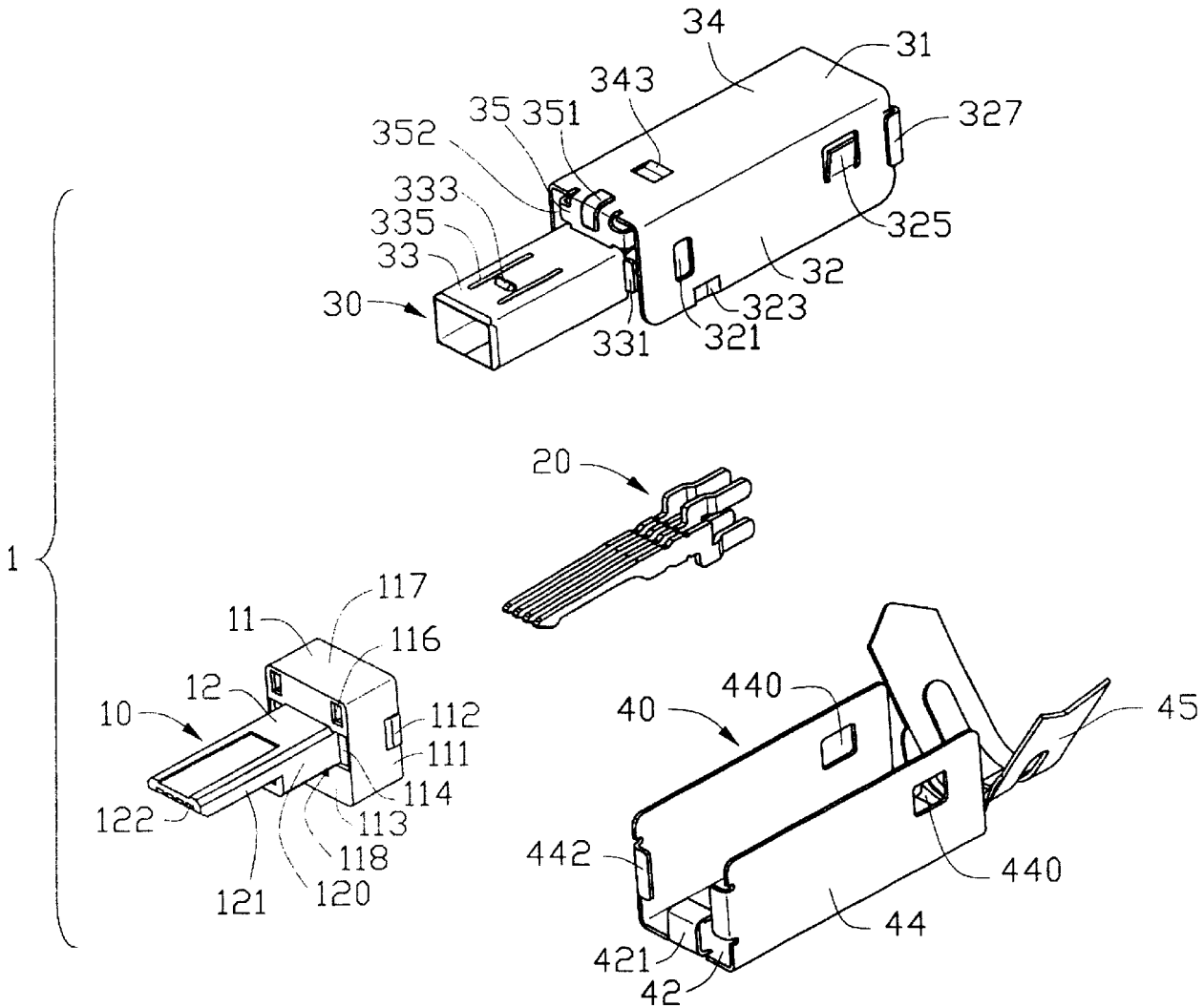
FIG. 1 is an exploded view of a mini USB connector in accordance with the present invention, in which an insulative casing portion of the connector is not shown.
Figure 4:
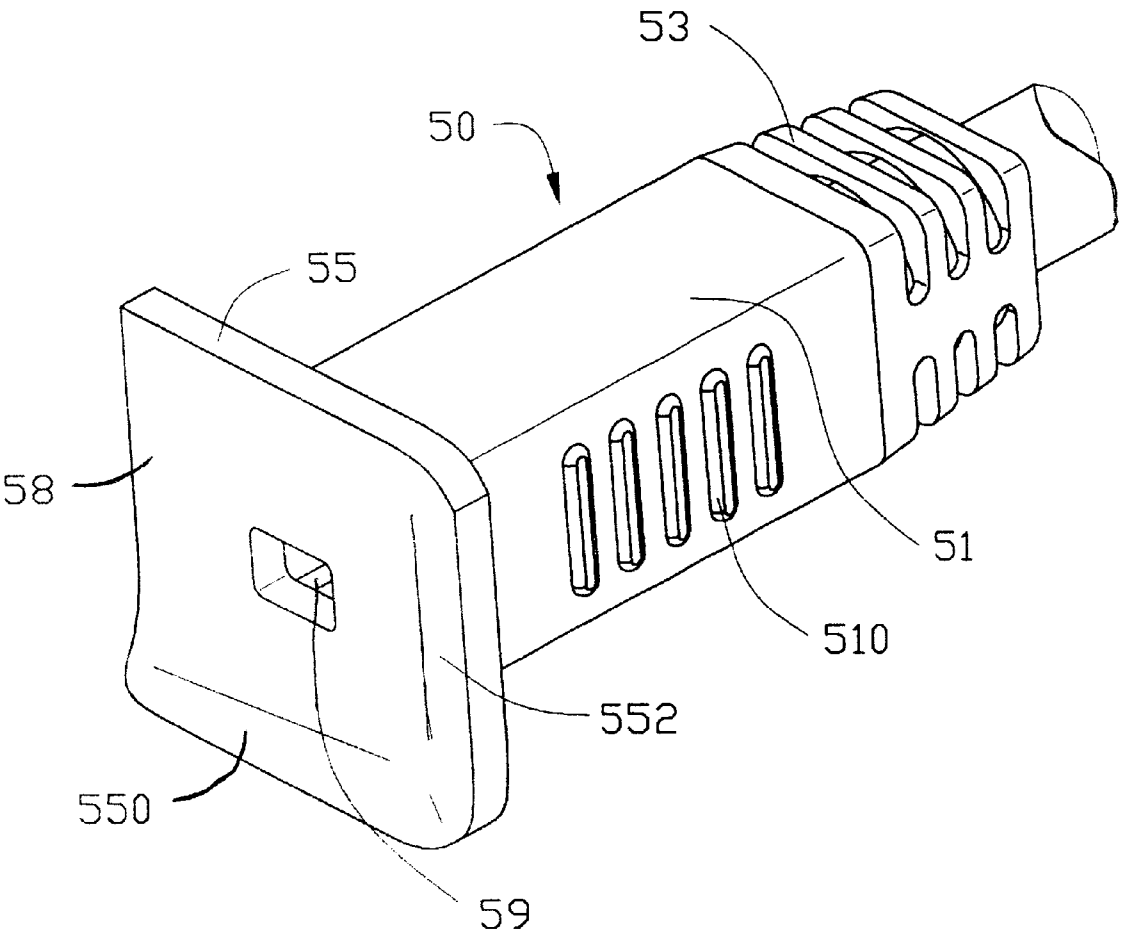
FIG. 4 is a perspective view of a casing portion of the mini USB connector in accordance with the present invention.

Referring to FIGS. 1 and 4, a mini USB cable connector 1 in accordance with the present invention comprises an insulative housing 10, a plurality of terminals 20, an upper shell 30, a lower shell 40 and an insulative casing portion 50.

Figure 2:
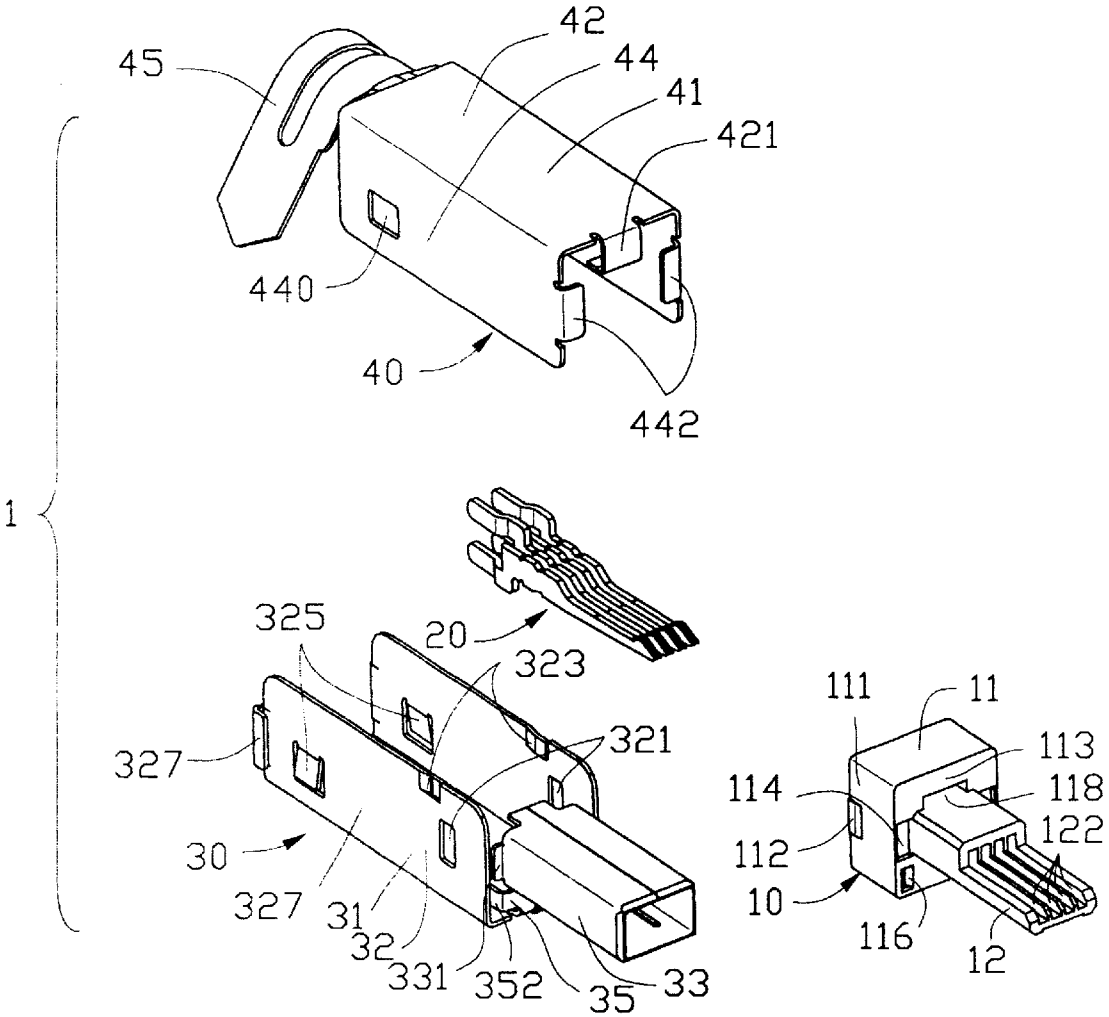
FIG. 2 is a view similar to FIG. 1, from another aspect.
Figure 3:
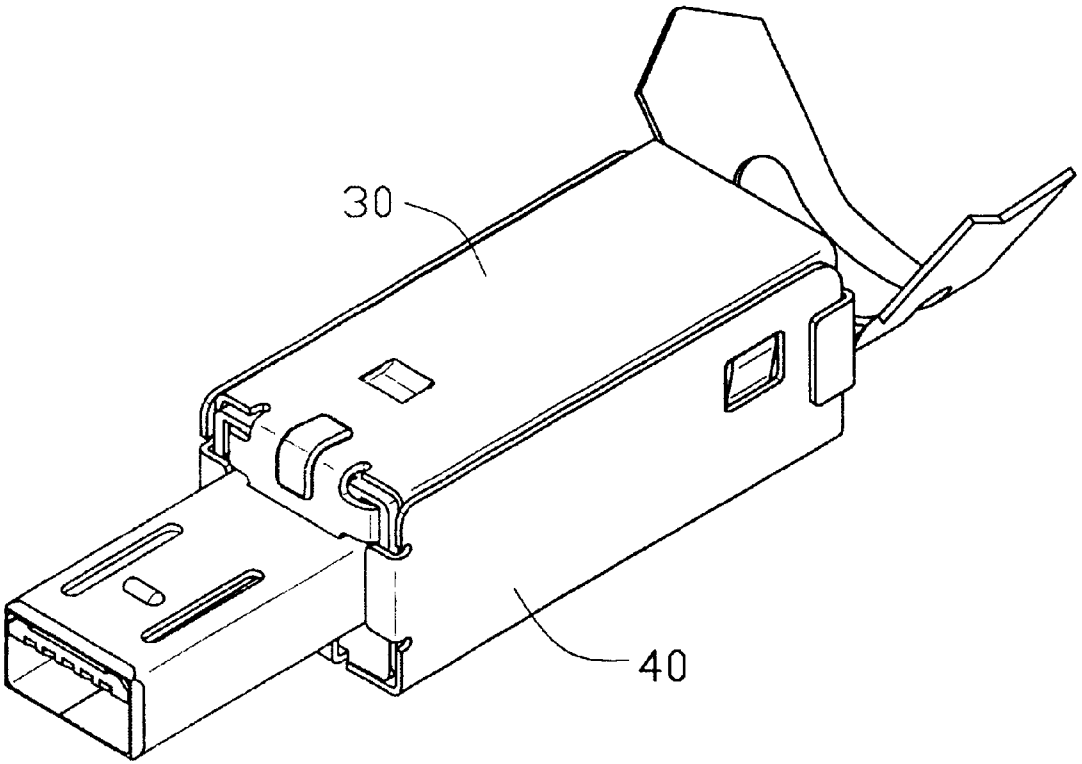
FIG. 3 is an assembled view of the mini USB connector of FIG. 1.

Referring to FIGS. 1 to 3, the insulative housing 10 includes a substantially rectangular main body 11 and a projection portion 12 projecting forwardly from a front surface 113 of the main body 11. The projection portion 12 comprises a first portion 120 integrally extending from the front surface 113 of the main body 11 and a second portion 121 extending from the first portion 120. The main body 11 and the projection portion 12 longitudinally define a plurality of passageways 122 for respectively receiving the terminals 20. A pair of apertures 116 is defined in the front surface 113 adjacent to an upper surface 117 of the main body 11. A pair of recesses 114 and a lower opening 118 are defined in the front surface 113 of the main body 11 around the projection portion 12. The pair of recesses 114 is located at two lateral sides of the main body 11, respectively, and the lower opening 118 is located below the projection portion 12. Each side surface 111 of the main body 11 forms a locking block 112 adjacent to a rear face of the main body 11.

The upper shell 30 comprises an upper section 31 and a mating frame 33 extending forwardly from a front edge of the upper section 31 for receiving the projection portion 12 of the insulative housing 10. The upper section 31 has an inverted-U shape and comprises a top wall 34 and a pair of lateral walls 32. A transition portion 35 bends downwardly from a front edge of the top wall 34 and connects the mating frame 33 with the upper section 31. A rib 351 is provided substantially at a middle of a junction of the front edge of the top wall 34 and the transition portion 35 for enhancing the connecting strength of the transition portion 35 and the upper section 31. A pair of retention arms 352 is bent rearwardly from opposite edges of the transition portion 35. Each lateral wall 32 includes a locking tongue 325 at a rear portion thereof and a locking tail 327 extending from a rear edge thereof. The locking tongues 325 are curved forwardly on outer faces of the lateral walls 32, respectively, for engaging with the lower shell 40 when the upper and lower shells 30, 40 are assembled together. A locking opening 321 is defined in each lateral wall 32 for receiving the corresponding locking block 112 of the main body 11 of the insulative housing 10. A top tab 343 is downwardly formed on the top wall 34, and a locking tab 323 is inwardly formed on each lateral wall 32. These tabs 343, 323 are used for abutting against the insulative housing 10 to retain the housing 10 in the upper shell 30. The mating frame 33 defines a pair of slits 335 on an upper face thereof and an embossment 333 between the slits 335 for engaging with a complementary connector (not shown). The complementary connector is mounted in a hand held electronic device, for example a digital camera or a PDA. A pair of side flanges 331 is bent outwardly from rear edges of opposite sides of the mating frame 33 for being received in the recesses 114 of the main body 11.

The lower shell 40 comprises a lower section 41 and an arcuate strain relief 45 for holding a cable (not shown) in electrical connection with the terminals 20. The lower section 41 has an inverted-U shape and comprises a bottom wall 42 and a pair of side walls 44 connecting with the bottom wall 42. A latching hole 440 is defined in each side wall 44 for receiving the locking tongue 325 of the lateral wall 32 of the upper shell 30. A latching arm 442 is bent inwardly from a front edge of each side wall 44 for pressing against the front surface 113 of the main body 11. A latching hook 421 upwardly extends from substantially a middle of a front edge of the bottom wall 42 for latching with the lower opening 118 of the main body 11.

During assembly, the terminals 20 are first inserted into the passageways 122 of the projection portion 12 of the insulative housing 10. The projection portion 12 of the insulative housing 10 is received in the mating frame 33 of the upper shell 30. The upper shell 30 and the lower shell 40 engage with each other to enclose the main body 11 of the insulative housing 10 therein and the lateral walls 32 of the upper shell 30 connects the side walls 44 of the lower shell 40. The retention arms 352 of the transition portion 35 are retained in the apertures 116 of the main body 11. The side flanges 331 of the mating frame 33 of the upper shell 30 are received in the recesses 114 of the main body 11 of the insulative housing 10. The locking openings 321 of the upper shell 30 receive the locking blocks 112 of the main body 11. The top tab 343 of the top wall 34 and the locking tabs 323 of the lateral walls 32 of the upper shell 30 respectively abut against the main body 11 of the insulative housing 10. The latching hook 421 of the lower section 41 of the lower shell 40 engages in the lower opening 118 of the main body 11 of the insulative housing 10. The latching arms 442 press against the front surface 113 of the main body 11, and also press against the side flanges 331 of the upper shell 30. The locking tongues 325 of the lateral walls 32 of the upper shell 30 engage in the latching holes 440 of the side walls 44 of the lower shell 40. The locking tails 327 latch with opposite rear edges of the side walls 44 of the lower shell 40. Thus, the upper shell 30 and the lower shell 40 are firmly fastened to each other, and the insulative housing 10 is firmly secured in the upper shell 30 and the lower shell 40.

Figure 5:
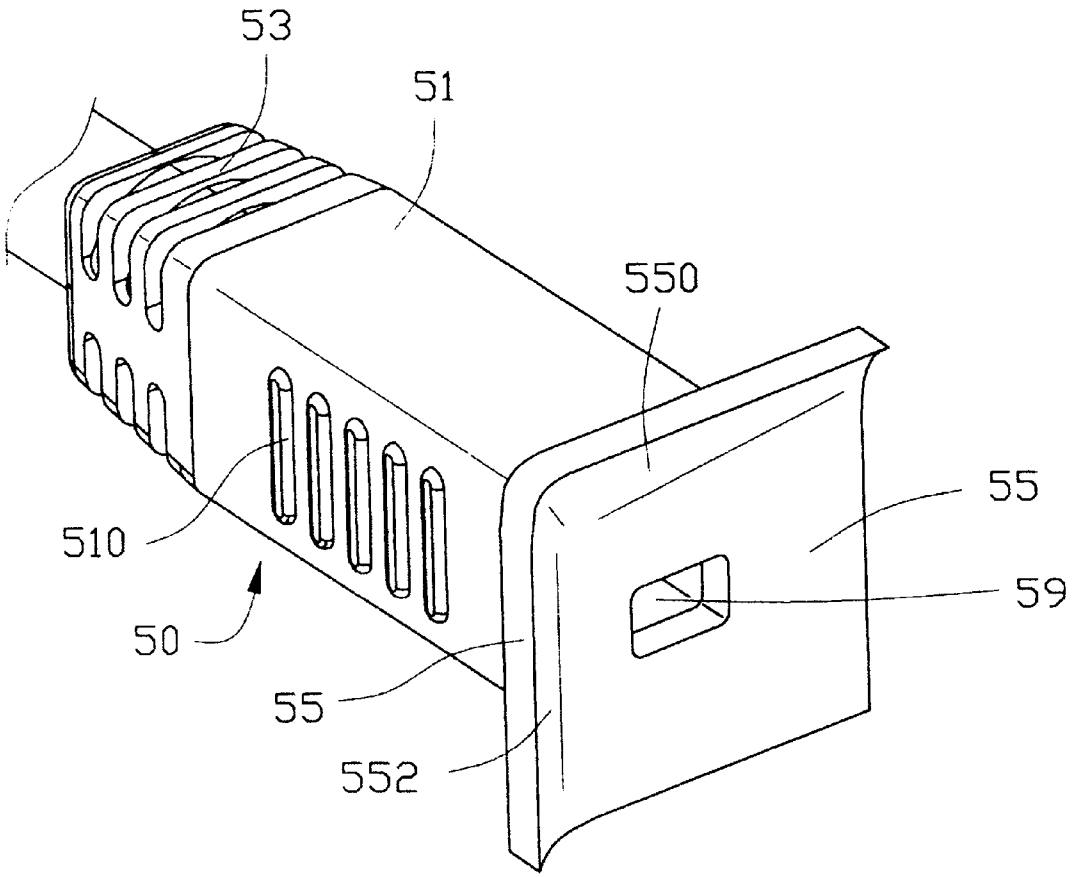
FIG. 5 is a view similar to FIG. 4, from another aspect.
Figure 6:
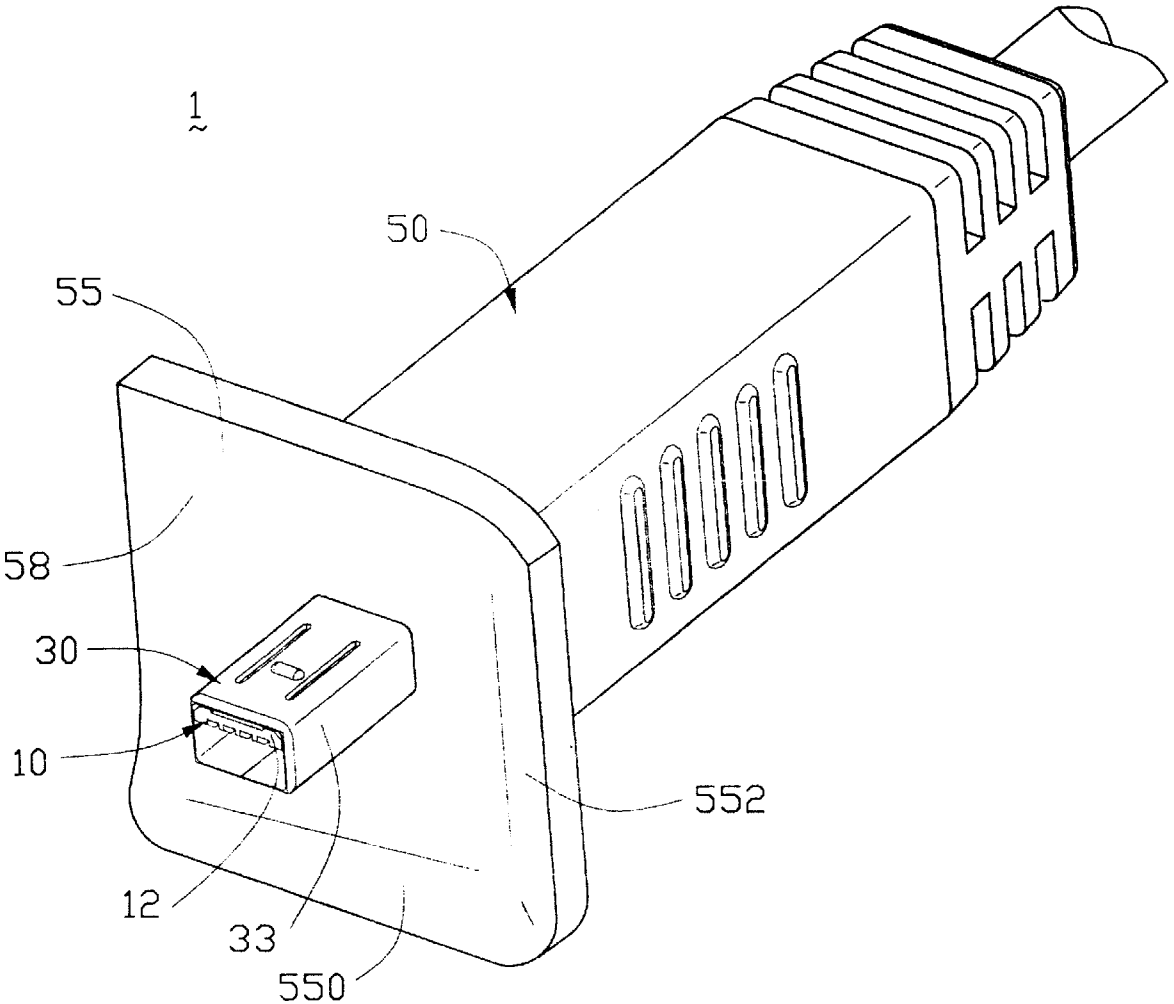
FIG. 6 is a perspective view of the mini USB connector in accordance with the present invention.
Figure 7:
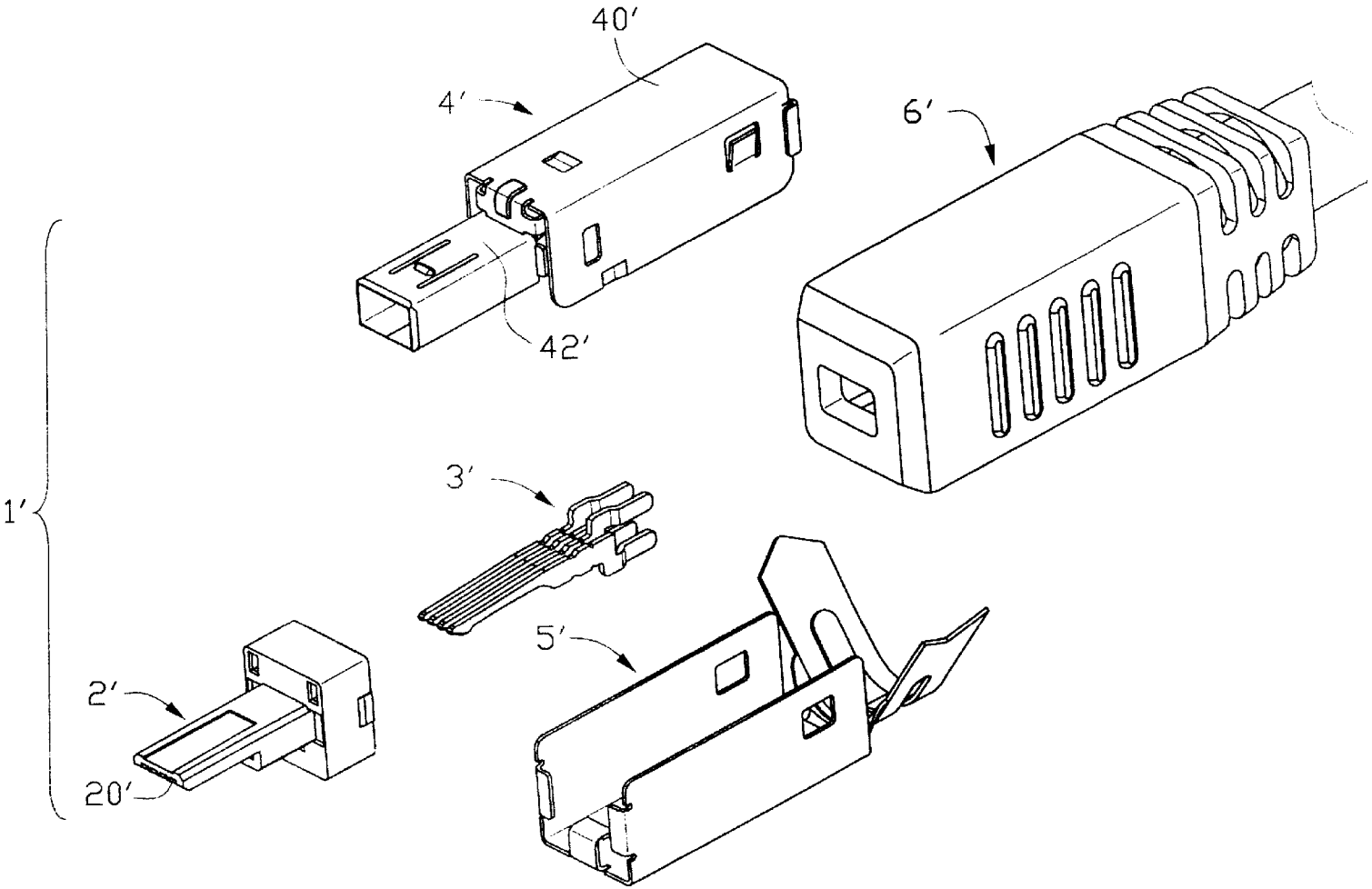
FIG. 7 (PRIOR ART)
FIG. 7 is an exploded view of a conventional mini USB cable connector.
Figure 8:
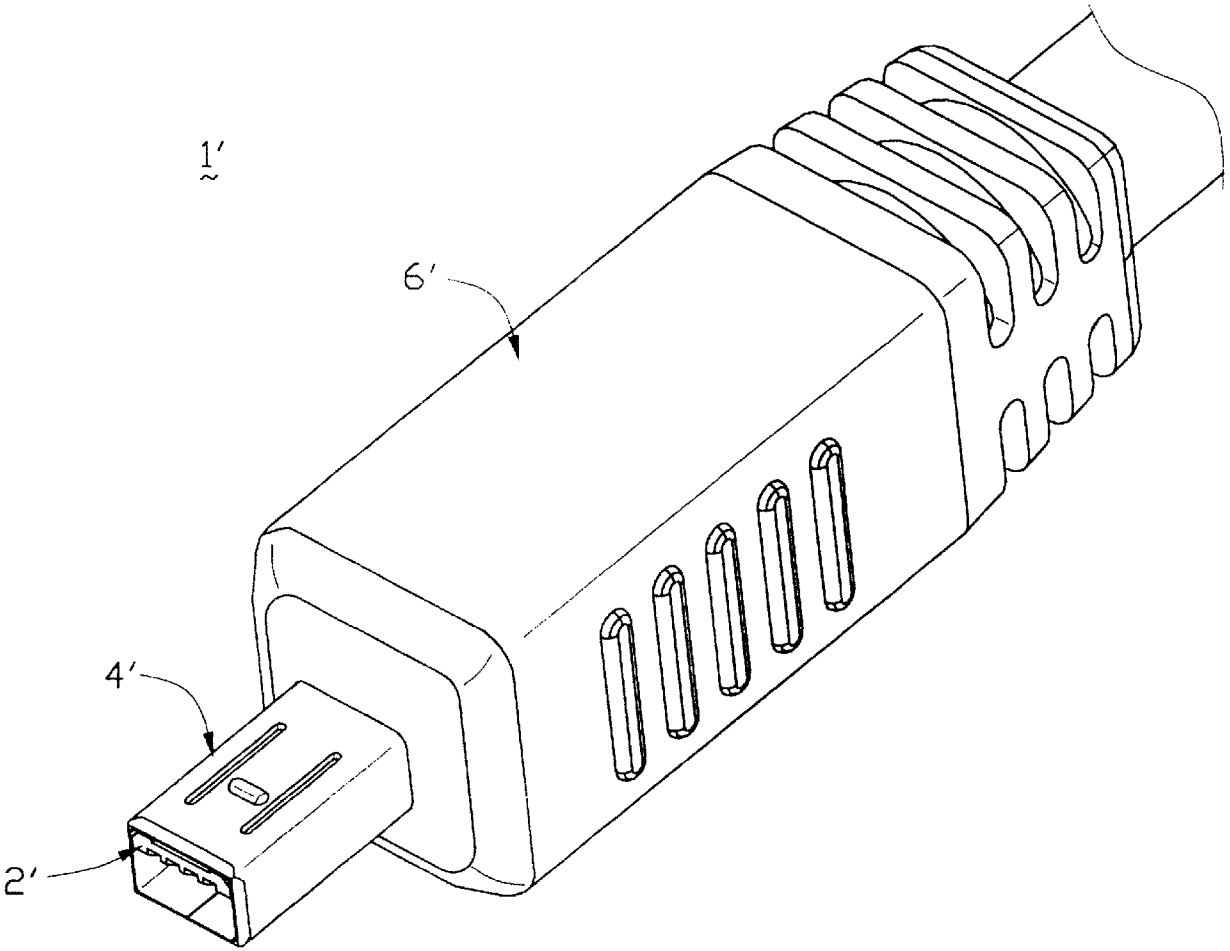
FIG. 8 (PRIOR ART)
FIG. 8 is an assembled view of the conventional mini USB cable connector of FIG. 7.

Please referring to FIGS. 4 to 6, the insulative casing portion 50 is insert molded to and encloses the upper shell 30 and the lower shell 40. The casing portion 50 comprises a cubical base 51, a strain relief 53 and an abutment wall 55. A plurality of ribs 510 is disposed on a pair of side walls of the base 51 for being grasped conveniently. The strain relief 53 extends rearwardly from the base 51 and defines a plurality of slots therein. The abutment wall 55 is in a substantially rectangular shape and is integrally formed at a front end of the base 51. The abutment wall 55 extends at the front end of the base 51 and is oriented generally perpendicularly to a longitudinal axis of the mini USB cable connector 1. A hole 59 is defined in the casing portion 50 extending rearwardly from a front surface 58 of the abutment wall 55. The mating frame 33 of the upper shell 30 with the protrusion portion 12 of the insulative housing 10 is located in front of the hole 59 and the front surface 58 of the abutment wall 55. Two adjacent flanges 550 and 552 of the abutment wall 55 are bent forwardly whereby the front surface 58 has a slightly forwardly curved configuration.

An outer surface of the hand held electronic device through which the complementary connector is exposed for insertion of the connector 1 therein usually has a slightly rearwards curved configuration. When the mini USB cable connector 1 in accordance with the present invention mates with the complementary connector, the shape of the front surface 58 of the abutment wall 55 conforms with the shape of the outer surface of the hand held electronic device. Moreover, the flanges 550, 552 of the abutment wall 55 are resilient so the front face 58 of the abutment wall 55 is intimately engaged with the outer surface of the hand held device. Therefore, the mini USB cable connector 1 is securely attached to the hand held electronic device and has a reliable electrical connection with the complimentary connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mating with a complementary connector in an electrical device, comprising:

an insulative housing comprising a main body, a projection portion extending forwardly from the main body, a plurality of passageways defined in the projection portion;

a plurality of terminals received in the passageways of the projection portion;

a conductive shell enclosing the insulative housing to thereby eliminate electromagnetic interference of the terminals; and an insulative casing portion enclosing the conductive shell and comprising a base with an abutment wall integrally formed on a front end thereof, the abutment wall, extending; generally perpendicularly to a longitudinal axis of the connector, the projection portion of the insulative housing being located in front of the abutment wall, the abutment wall being adapted for engaging with an outer face of the electrical device when the electrical connector mates with the complementary connector; said abutment wall defines an opening to allow said projection Portion to forwardly protrude, and is significantly radially expanded relative to the base with thereof at least one edge section curvedly forwardly bent a little bit for compliance with a contour of an outer surface of the electrical device;

wherein another edge section of said abutment wall, which is intersects with said one edge section, is also curvedly forwardly, bent a little bit, thus cooperating with said one edge section to form a curvedly recessed corner around an intersection of said two edge sections;

wherein the bent edge sections being resilient;

wherein a radial dimension of said abutment wall is generally twice with regard to that of said base.

2. The electrical connector as described in claim 1, wherein the abutment wall is substantially rectangular.

3. The electrical connector as described in claim 1, wherein the insulative casing portion comprises a cubical base.

4. The electrical connector as described in claim 1, wherein the conductive shell includes a mating frame enclosing the projection portion of the insulative housing.

5. The connector as described in claim 1, wherein a radial dimension of said abutment wall is generally twice with regard to that of said base.

6. The electrical connector as described in claim 1, wherein the conductive shell comprises an upper shell and a lower shell interlocking with each other.

7. The electrical connector as described in claim 6, wherein the mating frame extends forwardly form the upper shell.

* * * * *